US007458440B2

(12) United States Patent
Uegane

(10) Patent No.: US 7,458,440 B2
(45) Date of Patent: Dec. 2, 2008

(54) VEHICLE EXHAUST SYSTEM SUPPORT STRUCTURE

(75) Inventor: Masayuki Uegane, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 197 days.

(21) Appl. No.: 11/091,726

(22) Filed: Mar. 28, 2005

(65) Prior Publication Data

US 2005/0247516 A1 Nov. 10, 2005

(30) Foreign Application Priority Data

Apr. 1, 2004 (JP) ..... 2004-108738

(51) Int. Cl.

| | |
|---|---|
| ***F16F 15/04*** | (2006.01) |
| ***F01N 7/08*** | (2006.01) |
| ***F16L 55/033*** | (2006.01) |
| *F16F 15/08* | (2006.01) |
| *F16L 11/15* | (2006.01) |

(52) U.S. Cl. ..... 181/228; 181/227; 181/209; 285/49; 285/299

(58) Field of Classification Search ..... 181/228, 181/227, 249, 255; 285/49, 53, 50, 48, 299, 285/300, 302; 180/309, 89.2, 296, 68.3
See application file for complete search history.

(56) References Cited

U.S. PATENT DOCUMENTS

| | | | | | |
|---|---|---|---|---|---|
| 2,020,054 | A | * | 11/1935 | Ford | 180/296 |
| 2,512,823 | A | * | 6/1950 | Blundell | 181/255 |
| 2,515,391 | A | * | 7/1950 | Arbib | 293/113 |
| 2,568,409 | A | * | 9/1951 | Phillips | 293/113 |
| 2,841,232 | A | * | 7/1958 | Loeffler | 180/89.2 |
| 2,854,278 | A | * | 9/1958 | Zerhan, Jr. | 293/113 |
| 2,902,102 | A | * | 9/1959 | Gorman et al. | 180/309 |
| 2,965,404 | A | * | 12/1960 | Pittsley et al. | 293/113 |
| 2,979,357 | A | * | 4/1961 | Leach et al. | 293/113 |
| 2,992,035 | A | * | 7/1961 | Tell et al. | 293/113 |
| 3,459,444 | A | * | 8/1969 | Rofe | 285/226 |
| 3,574,358 | A | * | 4/1971 | Cassel | 285/53 |
| 3,581,842 | A | * | 6/1971 | Hall | 181/243 |
| 4,336,864 | A | * | 6/1982 | Asaka et al. | 181/255 |
| 4,779,703 | A | * | 10/1988 | Takiguchi et al. | 181/255 |
| 4,907,666 | A | | 3/1990 | Tecco et al. | |
| 5,321,214 | A | * | 6/1994 | Uegane et al. | 181/211 |
| 5,340,952 | A | * | 8/1994 | Takiguchi | 181/249 |

(Continued)

FOREIGN PATENT DOCUMENTS

| | | |
|---|---|---|
| EP | 0987409 A | 3/2000 |

(Continued)

*Primary Examiner*—Edgardo San Martin
(74) *Attorney, Agent, or Firm*—Carrier, Blackman & Associates, P.C.; Joseph P. Carrier; William D. Blackman

(57) ABSTRACT

In a vehicle exhaust system support structure, an upstream side exhaust pipe connected to an engine is guided to an inlet of a muffler supported on a vehicle body, and a downstream side exhaust pipe coupled to an outlet of the muffler is disposed in the interior of a rear bumper. The upstream side exhaust pipe and the inlet of the muffler are coupled to each other via a flexible tube, thus floatingly supporting the upstream side exhaust pipe in the muffler. The downstream portion of the upstream side exhaust pipe passes through the interior of the flexible tube, and is inserted into the inlet of the muffler.

23 Claims, 6 Drawing Sheets

U.S. PATENT DOCUMENTS

| | | | | |
|---|---|---|---|---|
| 5,677,518 | A * | 10/1997 | Fischer et al. | 181/255 |
| 5,904,378 | A * | 5/1999 | Bakker et al. | 285/55 |
| 5,955,707 | A * | 9/1999 | Fritz | 181/282 |
| 6,390,138 | B2 * | 5/2002 | Powell | 138/114 |
| 6,419,280 | B2 * | 7/2002 | Uegane et al. | 285/300 |
| 6,863,154 | B2 * | 3/2005 | Uegane et al. | 181/207 |
| 2002/0117346 | A1 | 8/2002 | Porter et al. | |
| 2005/0023076 | A1 * | 2/2005 | Huff et al. | 181/246 |
| 2005/0230182 | A1 * | 10/2005 | Nezan et al. | 181/250 |

FOREIGN PATENT DOCUMENTS

| | | |
|---|---|---|
| JP | 61-146428 | 9/1986 |
| JP | 1-91022 | 6/1989 |
| JP | 03-096434 | 4/1991 |
| JP | 3096434 | 4/1991 |
| JP | 2001-090530 | 4/2001 |
| JP | 2003-120282 | 4/2003 |
| WO | WO 01/69055 A | 9/2001 |
| WO | WO 03/056151 A | 7/2003 |

* cited by examiner

VEHICLE EXHAUST SYSTEM SUPPORT STRUCTURE

RELATED APPLICATION DATA

The Japanese priority application No. 2004-108738 upon which the present application is based is hereby incorporated in its entirety herein by reference.

BACKGROUND OF THE INVENTION

1. Field of the Invention

The present invention relates to an improvement of a vehicle exhaust system support structure in which exhaust gas discharged from an engine of a vehicle such as an automobile is guided to a muffler, muffled, and then released to the outside air.

2. Description of the Related Art

Conventionally, in a vehicle such as an automobile, an exhaust pipe of an exhaust system connected to an engine generally extends rearward beneath a vehicle body, and a tail pipe at the downstream end thereof is exposed below a rear bumper. For example, Japanese Utility Model Registration Application Laid-open No. 61-146428 (FIG. 3) discloses an arrangement in which an exhaust pipe (tail pipe) of an exhaust system is passed beneath a rear panel (rear bumper) 1, and an exhaust outlet 4 thereof is exposed to the outside. However, there is a problem that this exposure of the tail pipe to the outside is undesirable from the viewpoint of improvement of the appearance of the vehicle.

Japanese Patent Application Laid-open No. 3-96434 (FIG. 7 and 'Prior Art' section) discloses an arrangement as technical means for solving the above problem, in which a finisher 10A connected to an end part of a tail pipe 4A is disposed in the interior of a rear bumper 5A, and (in order to prevent exhaust gas from being caught up in the interior of the rear bumper) an open end of the finisher 10A is extended to an opening 6A formed in the rear bumper 5A. However, as is described in the above patent publication ('Problems to be Solved' section), since this conventional arrangement does not employ a structure for damping vibration of the tail pipe 4A (finisher 10A), it is necessary to ensure that a gap δ1 between the opening 6A of the rear bumper 5A and the open end of the finisher 10A is large so that the open end of the finisher 10A does not interfere with the edge of the opening 6A as a result of the vibration of the tail pipe 4A. That is, although the finisher 10A is disposed within the rear bumper 5A in order to improve the appearance, the gap δ1 is noticeable, leading to a further problem that a sufficient improvement in the appearance cannot be obtained.

In order to solve the problem of the noticeable gap δ1, Japanese. Patent Application Laid-open No. 3-96434 (FIG. 1 to FIG. 6) discloses an arrangement in which, by fixing a rear end part of a tail pipe 4 to a floor panel 14 by means of stays 12 and 13, a finisher 10 is prevented from swinging and interfering with an edge of an opening 6A of a rear bumper 5 even when the gap δ1 is reduced as much as possible, thus giving an effect in improving the appearance, and vibration of the exhaust system transmitted from the engine side is absorbed by a flexible tube 7 disposed partway along the tail pipe 4.

Although the flexible tube generally has an advantage that its vibration absorbing properties are high, there is a disadvantage that the axial core of the upstream side exhaust pipe and the axial core of the downstream side exhaust pipe, which are connected via the flexible tube, might be displaced from each other during vibration absorption, thus reducing the effective passage area of these exhaust pipes to increase the exhaust resistance. In the arrangement disclosed in Japanese Patent Application Laid-open No. 3-96434 (FIG. 1 to FIG. 6), the flexible tube 7 disposed partway along the tail pipe 4 provides a further problem of an increase in the exhaust resistance.

SUMMARY OF THE INVENTION

The present invention has been accomplished under the above-mentioned circumstances, and it is an object thereof to provide a novel vehicle exhaust system support structure that avoids any increase in exhaust resistance while further enhancing the effect in improving the appearance of the exhaust system by making the gap formed between a downstream side exhaust pipe and an exhaust pipe receiving part of a rear bumper as small as possible.

The exhaust pipe receiving part referred to herein, which is formed in the rear bumper, means a through hole that opens in a vertical wall portion of the rear bumper, or a cutout (recess) formed by cutting out a lower side of the vertical wall portion.

In order to attain this object, in accordance with the present invention, there is provided a vehicle exhaust system support structure in which a downstream portion of an upstream side exhaust pipe connected to an engine is guided to an exhaust inlet of a muffler supported on a vehicle body, and a terminal portion of a downstream side exhaust pipe coupled to an exhaust outlet of the muffler is received by an exhaust pipe receiving part formed in a vertical wall portion of a rear bumper supported on the vehicle body, wherein the downstream portion of the upstream side exhaust pipe and the exhaust inlet of the muffler are coupled to each other via a flexible tube, thus floatingly supporting the upstream side exhaust pipe in the muffler, and wherein the downstream portion of the upstream side exhaust pipe passes through the interior of the flexible tube and extends to the exhaust inlet.

In accordance with the present invention, since the downstream portion of the upstream side exhaust pipe which guides the exhaust gas from the engine to the muffler, is coupled to the exhaust inlet of the muffler via the flexible tube, it is possible to support the muffler on the vehicle body while the muffler is fixed to the vehicle body or displacement of the muffler relative to the vehicle body is greatly restricted, by absorbing, by means of this flexible tube, vibration of the exhaust system transmitted from the engine side. As a result, displacement of the downstream side exhaust pipe (tail pipe) which is connected to the muffler, relative to the vehicle body, that is, relative to the rear bumper, is greatly suppressed, and it becomes possible to reduce the gap between the exhaust pipe receiving portion (opening, cutout) of the vertical wall portion of the rear bumper and the terminal portion of the downstream side exhaust pipe, thereby achieving a sufficient effect in improving the appearance as a result of the downstream side exhaust pipe being received and disposed in the interior of the rear bumper.

Moreover, since the downstream portion of the upstream side exhaust pipe which guides the exhaust gas to the muffler, passes through the interior of the flexible tube and extends to the exhaust inlet of the muffler, the flexible tube does not cause any increase in exhaust resistance to the flow of exhaust gas through the exhaust system.

The above-mentioned object, other objects, characteristics, and advantages of the present invention will become apparent from a description of preferred embodiments that will be described in detail below by reference to the attached drawings.

DESCRIPTION OF THE PREFERRED EMBODIMENT

Figure 1:
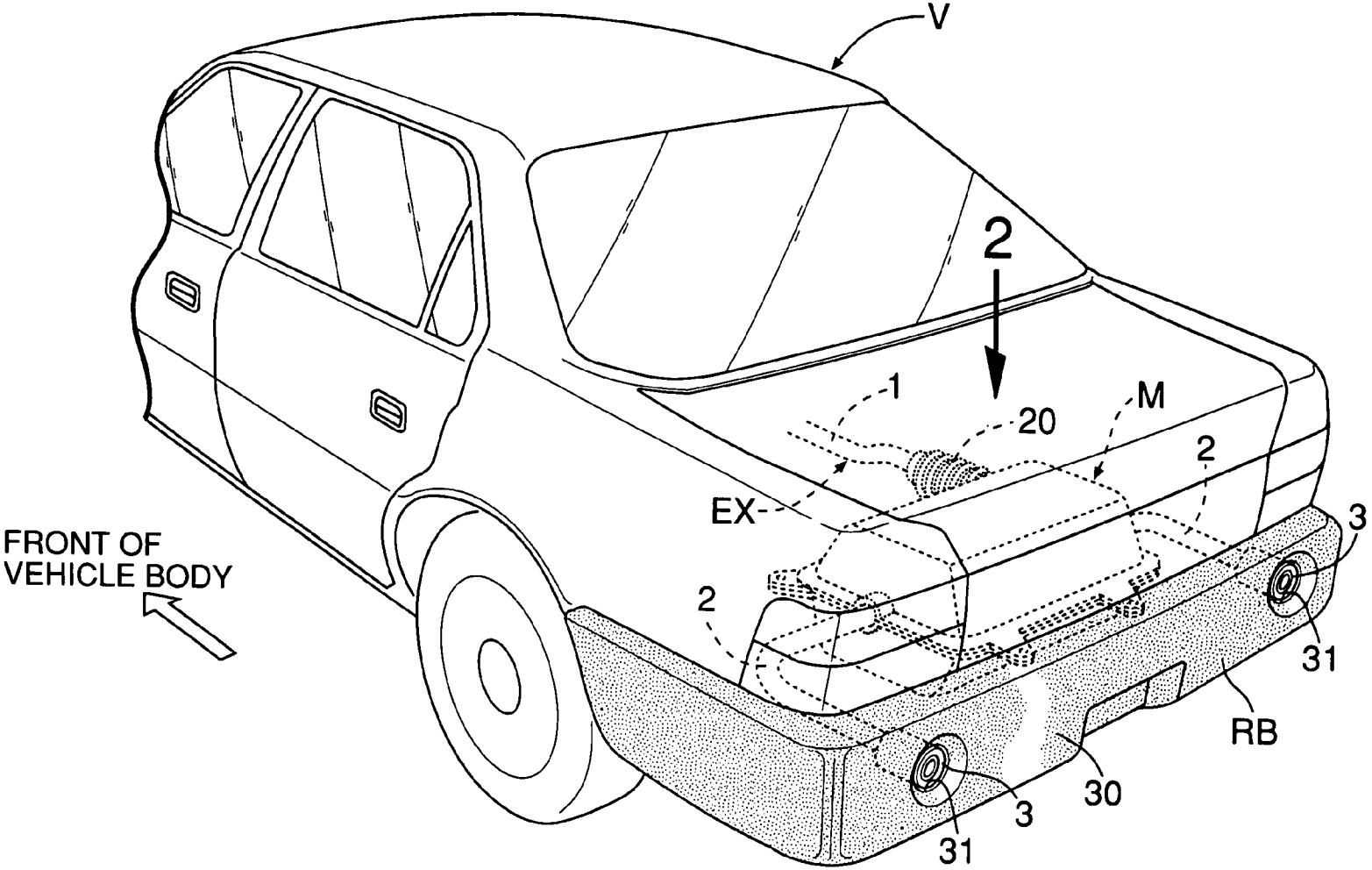
FIG. 1 is a perspective view of a rear part of a passenger automobile equipped with an exhaust system support structure according to a first embodiment of the present invention.
Figure 2:
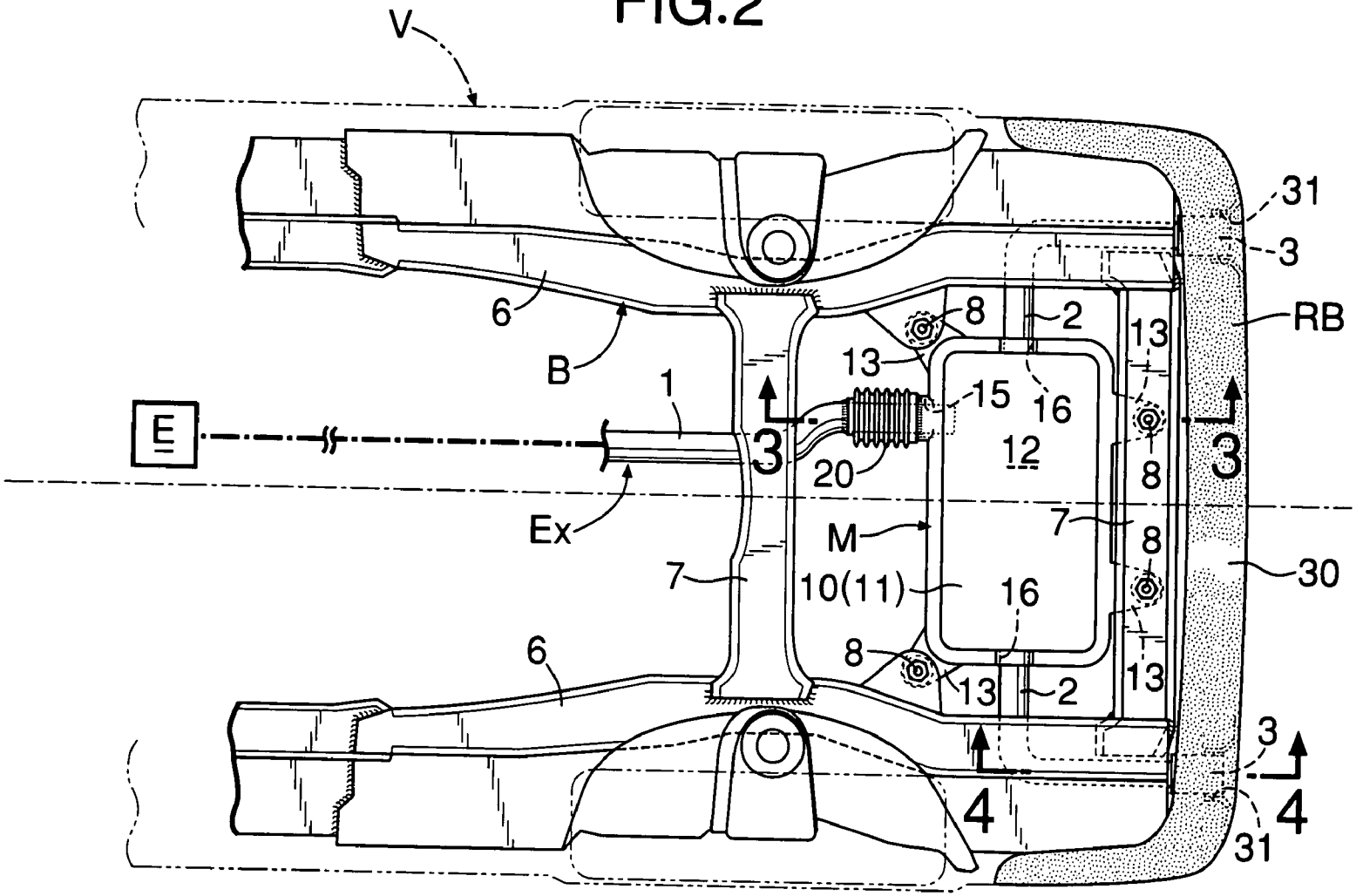
FIG. 2 is a transverse plan view of the rear part of the vehicle from arrow 2 in FIG. 1.

In FIGS. 1 and 2, an exhaust system Ex of an engine E of a passenger automobile V includes an upstream side exhaust pipe 1 connected to an exhaust manifold of the engine E, a muffler M into which exhaust gas flowing through the upstream side exhaust pipe 1 is guided and which muffles the exhaust noise of the exhaust gas, and two downstream side exhaust pipes 2 for discharging to the outside air the exhaust gas within the muffler M after it has been muffled.

The upstream side exhaust pipe 1 extends rearward in the fore-and-aft direction of the vehicle body while having an upstream part thereof connected to and communicating with the exhaust manifold of the engine E which is mounted in a front part of a vehicle body. A downstream portion of the upstream side exhaust pipe 1 extends to an exhaust inlet 15 of the muffler M with an annular gap d1, and the downstream end thereof reaches the interior of the muffler M (see FIG. 3).

The muffler M is formed into a sealed box shape which is long in the lateral direction, by integrally butt-joining a flange portion 10F of an upper half 10 and a flange portion 11F of a lower half 11, and an exhaust expansion chamber 12 is defined therewithin. This muffler M is supported detachably in a rear middle part of the vehicle body B; that is, a plurality of mounting tongue pieces 13 integrally project from the periphery of the muffler M. The mounting tongue pieces 13 are resiliently and detachably supported in side frames 6 and a cross member 7 of the vehicle body B by bolts and nuts 8 via resilient grommets 9.

Figure 3:
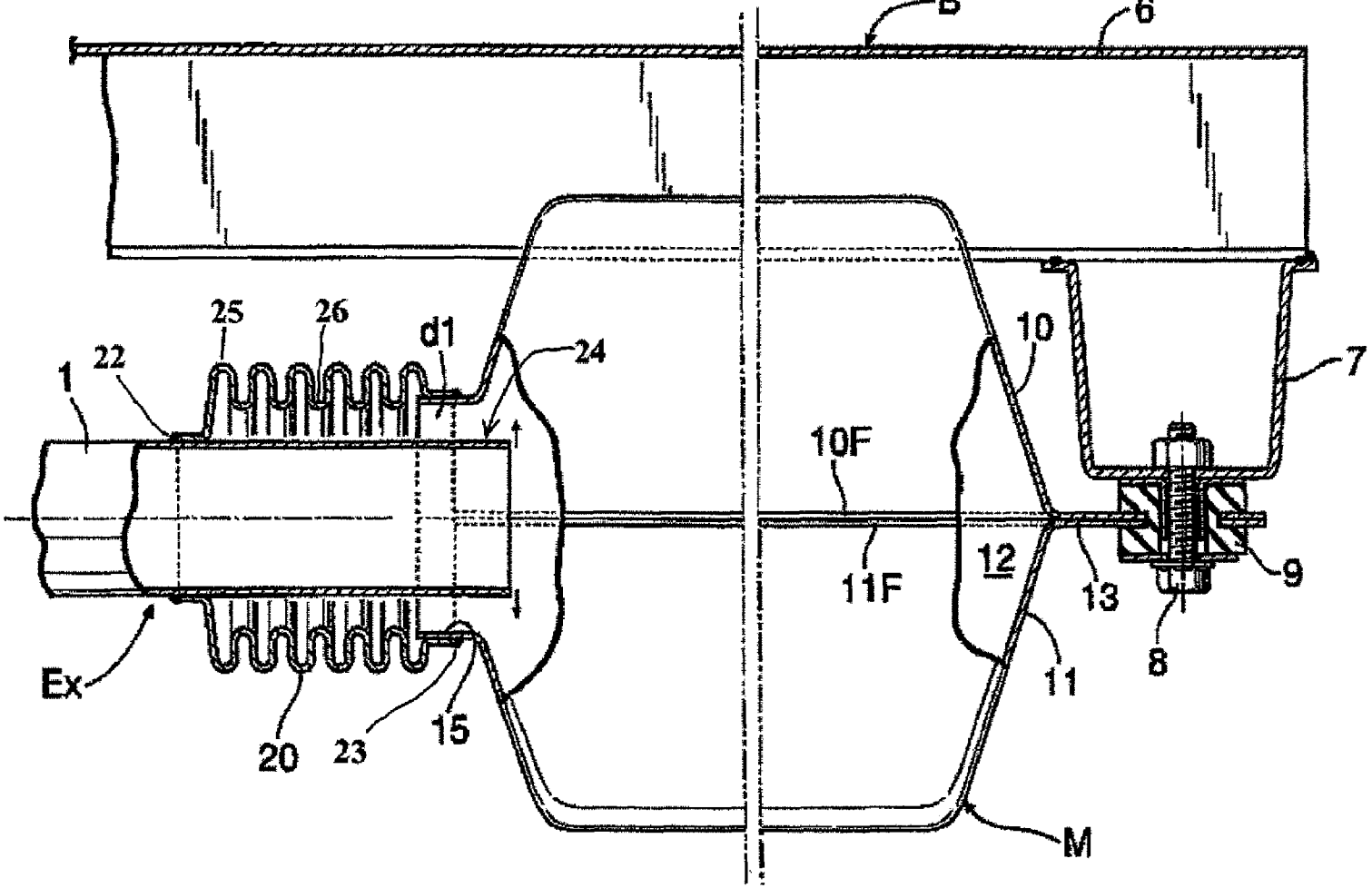
FIG. 3 is an enlarged sectional view along line 3-3 in FIG. 2.

As shown in FIGS. 2 and 3, an exhaust inlet 15 opens on a front wall of the muffler M, the exhaust inlet 15 being biased to one side laterally and opening toward the front of the vehicle body. As described above, the downstream portion of the upstream side exhaust pipe 1 extends to this exhaust inlet 15 with the annular gap d1, and the open end of the downstream portion reaches the interior of the exhaust expansion chamber 12 in the vicinity of the exhaust inlet 15. The downstream portion of the upstream side exhaust pipe 1 and the exhaust inlet 15 are hermetically coupled to each other by a heat resistant flexible tube 20 which covers them. As further shown in the drawing, the flexible tube 20 has a substantially corrugated configuration, including a plurality of larger diameter outer portions 25 alternating with a plurality of reduced diameter inner portions 26. One end of the flexible tube 20 is hermetically fixed to an outer peripheral face of the downstream portion of the upstream side exhaust pipe 1 at a first weld connection 22, and the other end thereof is hermetically fixed to an outer peripheral face of the exhaust inlet 15 of the muffler M at a second weld connection 23. The tip end 24 of the downstream portion of the upstream side exhaust pipe 1 is thereby swingably supported (floatingly supported) in the muffler M by the flexible tube 20 so as to define a free end which is capable of limited reciprocating swinging movement, so that vibration of the exhaust system transmitted from the engine L side can be absorbed effectively by the flexible tube 20.

As shown in FIG. 3, the downstream portion of the upstream side exhaust pipe 1 passes through the interior of the flexible tube 20 and the interior of the exhaust inlet 15 without making contact therewith, except at the first weld connection 22. The tip end 24 of the downstream portion of the upstream side exhaust pipe 1 is therefore a free end, as shown, which is supported so as to be capable of limited reciprocating swinging movement in a direction crossing an axis of the downstream portion of the upstream exhaust pipe, as shown by the opposed arrows in FIG. 3. Therefore, even when there is a relative displacement between the upstream side exhaust pipe 1 and the muffler M, there is no increase in the resistance to flow of the exhaust gas flowing through the upstream side exhaust pipe 1.

Figure 4:
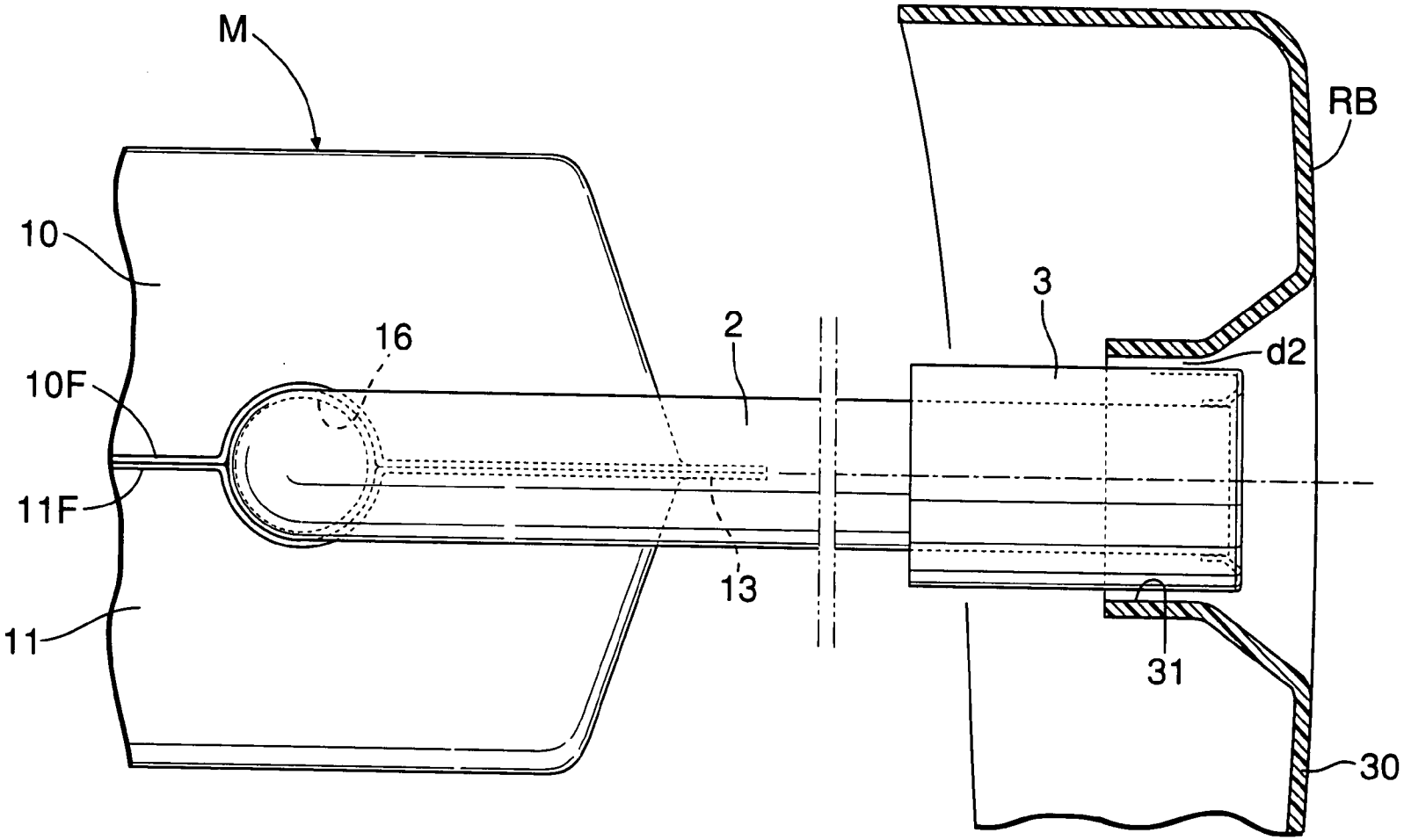
FIG. 4 is an enlarged sectional view along line 4-4 in FIG. 2.

As shown in FIGS. 2 and 4, a pair of left and right exhaust outlets 16 open laterally symmetrically on left and right sides of the muffler M, and upstream ends of the downstream side exhaust pipes (tail pipes) 2 are hermetically and fixedly connected to these exhaust outlets 16. Each of the downstream side exhaust pipes 2 is bent into an elbow shape so that it extends in the lateral direction of the vehicle body B, then bends and extends rearward. Finishers 3 are fixed to terminal portions of the downstream side exhaust pipes 2 in order to improve the appearance thereof.

As shown in FIGS. 1 and 4, through holes 31 are symmetrically formed, as exhaust pipe receiving parts, at the left and right of a vertical wall portion 30 of a rear bumper RB of the passenger automobile V. These through holes 31 open on front and rear faces of the vertical wall portion 30 of the rear bumper RB, and rear halves of the through holes 31 open out in a diverging shape. As is clearly shown in FIG. 4, the finisher 3 surrounds a rear portion of each of the downstream side exhaust pipes 2 forwardly of the bumper and is received within the through hole 31, and an outer end face of the finisher 3 is positioned inward of a rear face of the through hole 31, thus preventing the finisher 3 from projecting from an outer face of the rear bumper RB. Formed between an outer peripheral face of the finisher 3 and the through hole 31 is an annular gap d2, which prevents the finisher 3 and the through hole 31 from making contact with each other.

The operation of the first embodiment is now described.

When the engine E is run, the exhaust gas flows from an exhaust port of the engine E through the exhaust manifold to the upstream side exhaust pipe 1, and is guided therefrom to the muffler M. The exhaust gas that has flowed into the exhaust expansion chamber 12 within the muffler M is expanded and muffled here, and then discharged to the outside air via the two downstream side exhaust pipes (tail pipes) 2 and the finishers 3 at the terminal portions thereof.

Since the upstream side exhaust pipe 1 is floatingly supported in the muffler M by the flexible tube 20, vibration transmitted from the engine E to the upstream side exhaust pipe 1 can be absorbed by the flexible tube 20, and the muffler M can be supported on the vehicle body B in a state in which the muffler M is fixed to the vehicle body B or displacement of the muffler M relative to the vehicle body B is greatly restricted. As a result, there is very limited displacement of the downstream side exhaust pipe (tail pipe) 2 connected to the muffler M relative to the vehicle body B, that is, the rear bumper RB, the gaps d2 between the through holes 31 of the vertical wall portion 30 of the rear bumper RB and the downstream side exhaust pipes 2 can be made small, and the appearance can be greatly improved by disposing the downstream side exhaust pipes 2 within the rear bumper RB.

Moreover, since the upstream side exhaust pipe 1 for guiding the exhaust gas to the muffler M is passed through the interior of the flexible tube 20 and extends to the exhaust inlet 15 of the muffler M, although the upstream side exhaust pipe 1 is connected to the muffler M via the flexible tube 20, the exhaust resistance to the flow of exhaust gas through the exhaust system does not increase.

Figure 5:
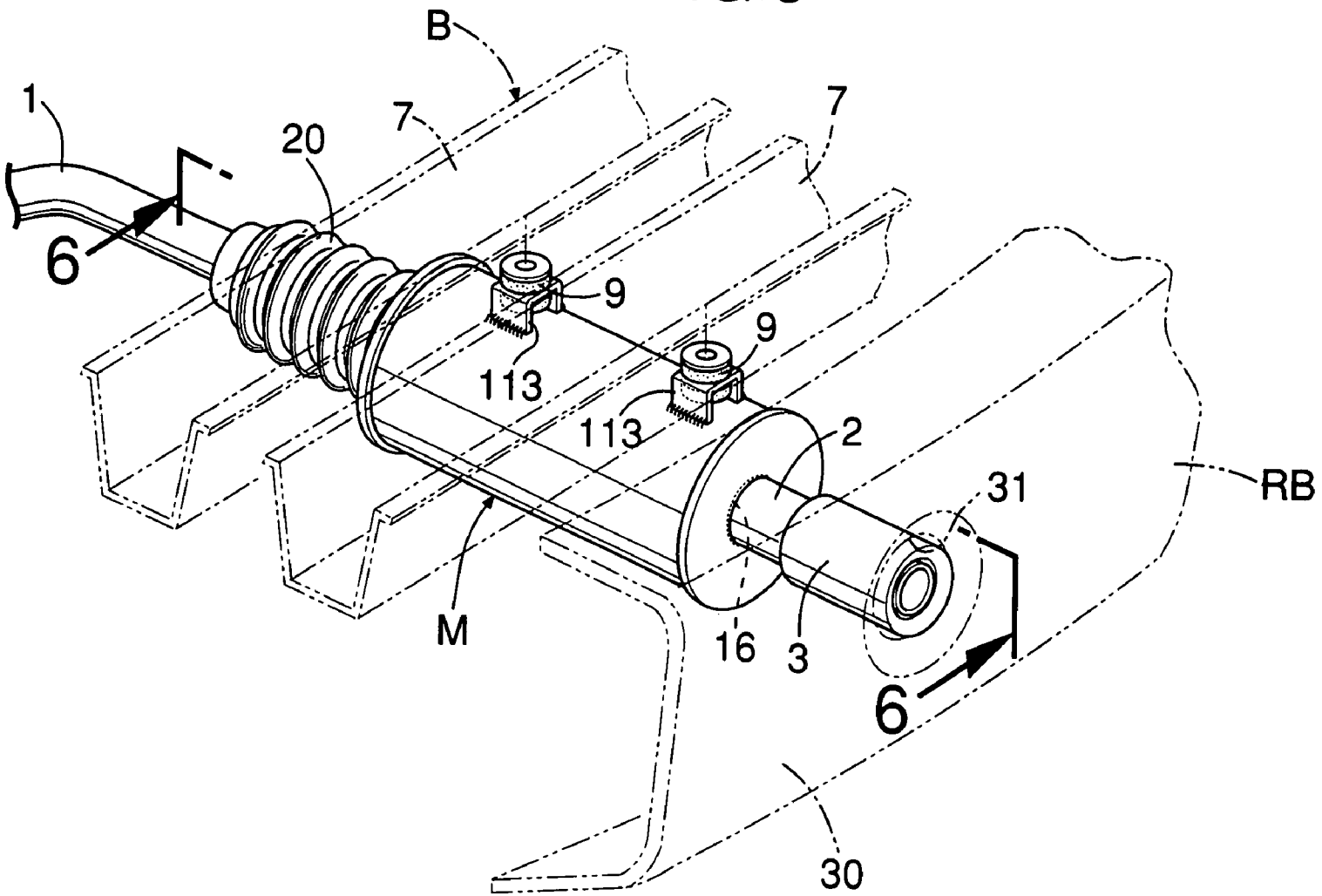
FIG. 5 is a perspective view of a vehicle exhaust system support according to a second embodiment of the present invention.
Figure 6:
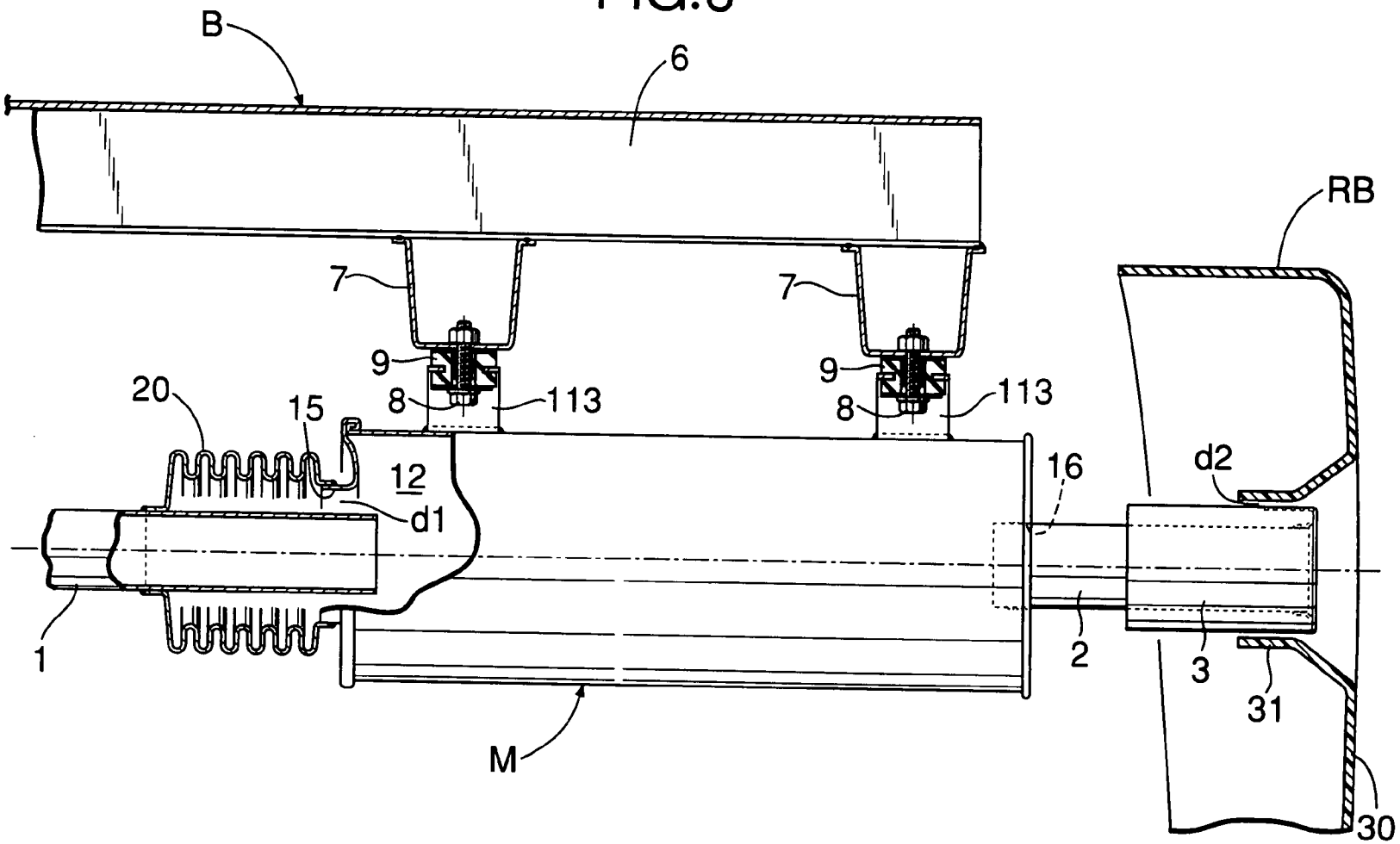
FIG. 6 is an enlarged sectional view along line 6-6 in FIG. 5.

A second embodiment of the present invention is described by reference to FIGS. 5 and 6. In these figures, the same parts as those of the first embodiment are denoted by the same reference numerals and symbols.

This second embodiment is different from the first embodiment with respect to the structures of a muffler M and a downstream side exhaust pipe (tail pipe) 2. The muffler M is formed into a sealed hollow cylindrical shape that is long in the fore-and-aft direction of a vehicle body B. An exhaust expansion chamber 12 is defined within the muffler M. Two mounting pieces 113 are fixed to front and rear parts of an upper face of the muffler M and are detachably fixed by bolts and nuts 8 to cross members 7 of the vehicle body B via resilient grommets 9, and the muffler M is thereby suspendedly supported in a rear part of the vehicle body B. An exhaust inlet 15 opens on a front wall of the muffler M. A downstream portion of an upstream side exhaust pipe 1 extends to an exhaust inlet 15 with an annular gap d1. An outlet of the upstream side exhaust pipe 1 opens within the exhaust expansion chamber 12 of the muffler M. A heat resistant flexible tube 20 is connected between the exhaust inlet 15 and the downstream portion of the upstream side exhaust pipe 1, and the downstream portion is thereby floatingly supported in the muffler M via the flexible tube 20. The downstream portion of the upstream side exhaust pipe 1 passes through within the flexible tube 20 with a gap, and extends to the exhaust inlet 15 of the muffler M. Furthermore, one downstream side exhaust pipe (tail pipe) 2 is fixedly coupled to an exhaust outlet 16 that opens on a rear wall of the muffler M. The downstream side exhaust pipe 2 extends linearly toward the rear of the vehicle body B and is integrally provided with a finisher 3 in the terminal portion thereof. The finisher 3 is received by a through hole 31 of a rear bumper RB with a gap d2 in a similar manner to that of the first embodiment.

This second embodiment exhibits the same operational effect as that of the first embodiment; an effect in improving the appearance by disposing the downstream side exhaust pipe 2 in the interior of the rear bumper RB can be exhibited sufficiently, and moreover there is no increase in exhaust resistance due to the presence of the flexible tube.

Although embodiments of the present invention have been described in detail above, the present invention can be modified in a variety of ways without departing from the subject matter of the present invention.

For example, in the embodiments the downstream side exhaust pipe (tail pipe) is equipped with the finisher in the terminal portion thereof, but this finisher is not essential. Furthermore, the embodiments illustrate cases in which the terminal portion of the downstream side exhaust pipe is received by the through hole opening in the vertical wall portion of the rear bumper, but the terminal portion of the downstream side exhaust pipe may be received by a cutout (recess) formed at the lower end of the vertical wall portion of the rear bumper. Moreover, in the embodiments the muffler employs a single expansion chamber structure, but it may employ a multiple expansion chamber structure or an arrangement in which a sound-absorbing material is applied to the interior as in a conventionally known muffler.

What is claimed is:

1. A vehicle exhaust system support structure in which a downstream portion of an upstream side exhaust pipe connected to an engine is guided to an exhaust inlet of a muffler supported on a vehicle body, and a terminal portion of a downstream side exhaust pipe coupled to an exhaust outlet of the muffler is received by an exhaust pipe receiving part formed in a vertical wall portion of a rear bumper supported on the vehicle body, wherein the downstream portion of the upstream side exhaust pipe and the exhaust inlet of the muffler are coupled to each other via a flexible tube, thus floatingly supporting the upstream side exhaust pipe in the muffler, and wherein the downstream portion of the upstream side exhaust pipe passes through the interior of the flexible tube and extends to the exhaust inlet, and wherein the downstream portion of the upstream side exhaust pipe comprises a tip portion supported by the flexible tube so as to define a free end which is capable of limited reciprocating swinging movement in a direction crossing an axis of the downstream portion of the upstream side exhaust pipe.

2. A vehicle exhaust system support structure according to claim 1, further including another exhaust outlet; and wherein said exhaust outlets open laterally symmetrically on left and right sides of the muffler, respectively.

3. A vehicle exhaust system support structure according to claim 1, wherein an annular gap is formed within the muffler between an inner periphery of said exhaust inlet, and the outer periphery of the upstream side exhaust pipe.

4. A vehicle exhaust system support structure according to claim 1, wherein the flexible tube is formed of heat-resistant material.

5. A vehicle exhaust system support structure according to claim 1, wherein the downstream portion of the upstream side exhaust pipe and the exhaust inlet of the muffler are hermetically coupled to each other by said flexible tube.

6. A vehicle exhaust system support structure according to claim 1, wherein one end of the flexible tube is hermetically fixed to an outer peripheral face of the downstream portion of the upstream side exhaust pipe and the other end thereof is hermetically fixed to an outer peripheral face of the exhaust inlet of the muffler.

7. A vehicle exhaust system support structure according to claim 1, wherein during vehicle operation the flexible tube is operable to absorb vibration of an exhaust system transmitted from the engine.

8. A vehicle exhaust system support structure according to claim 1, wherein the downstream portion of the upstream side exhaust pipe passes through an interior portion of the exhaust inlet of the muffler without making contact therewith.

9. A vehicle exhaust system support structure according to claim 1, further comprising a finisher pipe fixed to the terminal portion of the downstream side exhaust pipe; and the exhaust pipe receiving part having a through hole formed therein;

wherein the finisher pipe is disposed inward of rear face of the through hole; and an annular gap is formed between an outer peripheral face of the finisher pipe and the through hole; and wherein said annular gap is adapted to restrain the finisher pipe and the through hole from making contact with each other.

10. A vehicle exhaust system support structure comprising:

an upstream side exhaust pipe having an upstream portion and a downstream portion; said upstream portion connected to an engine exhaust and said downstream portion connected to an exhaust inlet of a muffler via a flexible tube;

a downstream side exhaust pipe connected to an exhaust outlet of the muffler; said downstream side exhaust pipe having a terminal end for releasing the engine exhaust;

a finisher pipe connected to the terminal end of the downstream side exhaust pipe;

a vertical wall portion of a rear bumper having a through hole formed therein which is adapted to receive the finisher pipe therein with an annular gap formed between peripheries of the through hole and the finisher pipe;

wherein the downstream portion of the upstream side exhaust pipe is hermetically connected to the exhaust inlet of the muffler via the flexible tube; wherein said upstream side exhaust pipe comprises a tip portion which is swingably supported in the muffler so as to define a free end which is capable of limited reciprocating swinging movement in a direction crossing an axis of the downstream portion of the upstream side exhaust pipe; wherein said flexible tube is adapted to absorb vibrations of the exhaust system transmitted from the engine;

wherein the downstream portion of the upstream side exhaust pipe passes through the interior of the flexible tube and extends to the exhaust inlet; and wherein said finisher pipe is confined within an outer face of the rear bumper.

11. A vehicle exhaust system support structure according to claim 10, wherein the downstream portion of the upstream side exhaust pipe does not make direct contact with the exhaust inlet of the muffler.

12. In a vehicle of the type having an exhaust system, the improvement comprising a vibration dampening support structure for the vehicle exhaust system, said support structure comprising:

a downstream portion of an upstream side exhaust pipe connected to an engine guided to an exhaust inlet of a muffler supported on a vehicle body; and a terminal portion of a downstream side exhaust pipe coupled to an exhaust outlet of the muffler; said terminal portion having a finisher pipe disposed thereon which is received by an exhaust pipe receiving part formed in a vertical wall portion of a rear bumper supported on the vehicle body, wherein the downstream portion of the upstream side exhaust pipe and the exhaust inlet of the muffler are coupled to each other via a flexible tube; and wherein the downstream portion of the upstream side exhaust pipe passes through the interior of the flexible tube and extends to the exhaust inlet; wherein an annular gap is formed between inner periphery of the exhaust inlet of the muffler and the outer periphery of the downstream portion of the upstream side exhaust pipe;

wherein said flexible tube floatingly supports the upstream side exhaust pipe in the muffler, and wherein the downstream portion of the upstream side exhaust pipe comprises a tip portion supported by the flexible tube so as to define a free end which is capable of limited reciprocating swinging movement in a direction crossing an axis of the downstream portion of the upstream side exhaust pipe, and wherein the flexible tube is configured to dampen vibration of the engine exhaust flowing into the muffler.

13. A vibration dampening support structure according to claim 12, further including another exhaust outlet; and wherein said exhaust outlets open laterally symmetrically on left and right sides of the muffler, respectively.

14. A vibration dampening support structure according to claim 12, wherein the flexible tube is formed of heat-resistant material.

15. A vibration dampening support structure according to claim 12, wherein the downstream portion of the upstream side exhaust pipe and the exhaust inlet of the muffler are hermetically coupled to each other by the flexible tube.

16. A vibration dampening support structure according to claim 12, wherein one end of the flexible tube is hermetically fixed to an outer peripheral face of the downstream portion of the upstream side exhaust pipe and the other end thereof is hermetically fixed to an outer peripheral face of the exhaust inlet of the muffler.

17. A vibration dampening support structure according to claim 12, wherein the outer periphery of the finisher pipe and inner periphery of the through hole form an annular gap therebetween; and wherein said annular gap is adapted to restrain the finisher pipe and the through hole from making contact with each other.

18. The vehicle exhaust system support structure of claim 1, wherein the flexible tube has a substantially corrugated configuration including a plurality of larger-diameter outer portions alternating with a plurality of reduced-diameter inner portions.

19. The vehicle exhaust system support structure of claim 10, wherein the flexible tube has a substantially corrugated configuration including a plurality of larger-diameter outer portions alternating with a plurality of reduced-diameter inner portions.

20. The vehicle exhaust system support structure of claim 12, wherein the flexible tube has a substantially corrugated configuration including a plurality of larger-diameter outer portions alternating with a plurality of reduced-diameter inner portions.

21. The vehicle exhaust system support structure of claim 9, wherein the finisher pipe surrounds a rear portion of the downstream side exhaust pipe forwardly of the rear bumper.

22. The vehicle exhaust system support structure of claim 10, wherein the finisher pipe surrounds a rear portion of the downstream side exhaust pipe forwardly of the rear bumper.

23. The vehicle exhaust system support structure of claim 12, wherein the finisher pipe surrounds a rear portion of the downstream side exhaust pipe forwardly of the rear bumper.

* * * * *